US006247469B1

(12) United States Patent
Guard

(10) Patent No.: US 6,247,469 B1
(45) Date of Patent: Jun. 19, 2001

(54) WARMER FOR A SPORTING ELEMENT

(76) Inventor: Tony Michael Guard, 316 W. 4th St., Cincinnati, OH (US) 45202

( * ) Notice: Subject to any disclaimer, the term of this patent is extended or adjusted under 35 U.S.C. 154(b) by 0 days.

(21) Appl. No.: 09/425,119

(22) Filed: Oct. 22, 1999

Related U.S. Application Data

(60) Provisional application No. 60/105,609, filed on Oct. 26, 1998.

(51) Int. Cl.[7] ..... F24J 1/00

(52) U.S. Cl. ..... 126/263.01; 126/229; 126/263.03; 219/759; 206/315.1

(58) Field of Search ..... 126/226, 229, 126/263.01, 263.03, 263.02, 262, 204, 400; 252/70; 165/10, 104.21, 104.12; 206/315.1, 579; 219/759

(56) References Cited

U.S. PATENT DOCUMENTS

| | | | | |
|---|---|---|---|---|
| 2,733,710 | * | 2/1956 | Zibell | 126/263.01 |
| 4,451,383 | * | 5/1984 | Arrhenius | 126/263.03 |
| 4,545,362 | | 10/1985 | Hendricks | 126/263 |
| 4,793,532 | | 12/1988 | Cash | 224/202 |
| 4,880,953 | * | 11/1989 | Manker | 126/263.03 |
| 5,062,528 | | 11/1991 | Whitaker, Jr. | 206/315.3 |
| 5,211,949 | | 5/1993 | Salyer | 424/405 |
| 5,424,519 | | 6/1995 | Salee | 219/759 |
| 5,513,629 | * | 5/1996 | Johnson | 126/263.01 |
| 5,588,529 | | 12/1996 | Speck | 206/315.1 |
| 5,630,961 | | 5/1997 | Salee | 219/759 |
| 5,660,751 | | 8/1997 | O'Rorke et al. | 219/411 |
| 5,687,705 | * | 11/1997 | Blair | 126/226 |
| 5,695,067 | | 12/1997 | Harvey | 206/579 |
| 5,786,574 | * | 7/1998 | Garnett | 126/229 |
| 5,804,266 | * | 9/1998 | Salyer | 126/263.01 |

* cited by examiner

*Primary Examiner*—James C. Yeung
(74) *Attorney, Agent, or Firm*—Haverstock, Garrett & Roberts LLP

(57) ABSTRACT

A warmer for a sporting element used for striking another element, the sporting element to be warmed including a sidewall having a predetermined shape enclosing a space, the warmer including an inner layer of thermally conductive material defining a cavity having a shape adapted for receiving at least a substantial portion of the sporting element with the inner layer in intimate relation therewith; an outer layer of thermal insulating material at least substantially containing the inner layer; and an intermediate layer comprising at least one microwave heatable element or substance disposed between the inner layer and the outer layer. According to another aspect of the invention, the warmer can include a heatable element placeable within a hollow portion or cavity of a sporting element, the heatable element being heatable by placement in the warmer, or in a microwave oven.

16 Claims, 4 Drawing Sheets

WARMER FOR A SPORTING ELEMENT

This Patent Application claims priority from U.S. Provisional Patent Application Ser. No. 60/105,609, filed Oct. 26, 1998.

TECHNICAL FIELD

This invention relates generally to warmers for sporting devices for preventing damage thereto when used under cool ambient conditions and for enhancing the performance thereof, and more particularly, to a warmer for a sporting element used for striking another element, which warmer is conformable in intimate contact with the sporting element and includes a microwave heatable element or substance for the warming function.

BACKGROUND ART

In recent years, technological developments in the area of sporting elements used for striking other elements, such as bats used for striking a ball or the like, have resulted in the use of advanced metallic alloys such as aluminum alloys, titanium alloys, and the like, in the construction of the sporting elements. Typically the sporting element includes a barrel or head having a thin sidewall of the metal alloy enclosing a space containing air alone, air contained in a bladder of elastomeric material, or a foamed polymeric material. Such alloys include, but are not limited to, CU-31 alloy and C405 alloy, now commonly used in bats for baseball and softball.

One problem discovered with sporting elements made with such new materials, including the above referenced alloys, is that the material turns brittle in colder weather, making it more likely for a dent or crack to be formed in the wall of the sporting element upon violent or forceful contact with another element, such as a ball. For this reason, many manufacturers do not recommend using bats made from such alloys if the temperature is below 65° F. Many such bats lack a warranty, such that a player assumes all risks of using such bat under ambient temperature condition of below 65° F.

Reference Blair U.S. Pat. No. 5,687,705 issued Nov. 17, 1997 which discloses an aluminum baseball or softball bat warmer which attempts to address the aforementioned problem. Also reference Whitaker, Jr. U.S. Pat. No. 5,062,528 issued Nov. 5, 1991 which disclosed a heated golf bag apparatus for warming golf clubs and related elements. Reference further Hendricks U.S. Pat. No. 4,545,362 issued Oct. 8, 1985 which discloses a golf ball heater. However, none of the known devices provide a simple, convenient, easy to use and compact warmer for sporting elements. Accordingly, the present invention is directed to overcoming one or more of the problems as set forth above.

DISCLOSURE OF THE INVENTION

In one aspect of the present invention, a warmer for a sporting element used for striking another element is disclosed, the sporting element to be warmed including a sidewall having a predetermined shape enclosing a space, the warmer including an inner layer of thermally conductive material defining a cavity having a shape adapted for receiving at least a portion of the sporting element to be warmed with the inner layer of the warmer in intimate relation therewith; an outer layer of thermal insulating material at least substantially containing the inner layer; and an intermediate layer comprising at least one microwave heatable element or substance disposed between the inner layer and the outer layer, the microwave heatable element or substance, when heated, transferring heat to the sporting element through the inner layer.

According to a preferred embodiment, the present warmer is adapted for warming a bat for baseball or softball, the bat having an elongate neck and a head or barrel wider than the neck, the inner layer of the warmer defining a cavity adapted for receiving the head or barrel and a desired portion of the neck of the bat with the inner layer in generally conforming relation therewith, and the at least one microwave heatable element or substance being disposed between the inner and outer layers for warming the bat.

According to another preferred aspect of the invention, the present warmer is adapted for warming a golf club, the golf club having an elongate shaft and a head wider than the shaft, the inner layer of the warmer forming a cavity adapted for receiving the club head with the inner layer in generally conforming, intimate relation therewith, and the at least one microwave heatable element or substance being disposed between the inner and outer layers for warming the club head.

The microwave heatable element or substance can be permanently disposed between the inner layer and the outer layer, the entire warmer being insertable into a microwave oven to heat the microwave heatable element or substance. Alternatively, the microwave heatable element or substance can be contained in a removable packet so as to be heatable while still in the warmer, or separately therefrom.

According to another preferred aspect of the invention, a heatable element can be removably or permanently located in a hollow portion or cavity of the sporting element, such as the barrel of a bat. The heatable element can be heated by the warmer through the sidewall of the sporting element while in place within the hollow portion or cavity, or removed and placed in the warmer, either alone or with the sporting element, then placed back into the hollow portion or cavity of the sporting element prior to use, for maintaining the sporting element warm for a long time. According to another aspect of the invention, the heatable element itself can be microwaveable, so as to be heated in a microwave oven, then placed in the sporting element.

It is an important object of the present invention to warm or heat the sporting element by transfer of heat from the heated element or substance to enhance performance of the sporting element and to prevent damage to the sporting element in use under ambient temperatures of about 65° F. and below, and in this regard, a wide variety of commercially available heatable elements and substances can be used with satisfactory results. For instance, the microwave heatable element or substance can include, but is not limited to, a wide variety of commercially available heatable gel packs, or a mixture of a liquid phase material including a microwave active fluid and a solid phase material including phase-change particles suspended in the liquid phase. As still another alternative, the microwave heatable element or substances can include a mixture of a first powder including calcium silicate impregnated with a microwave sensitive material, and a second powder comprising calcium silicate impregnated with a phase change material.

BEST MODE FOR CARRYING OUT THE INVENTION

Figure 1:
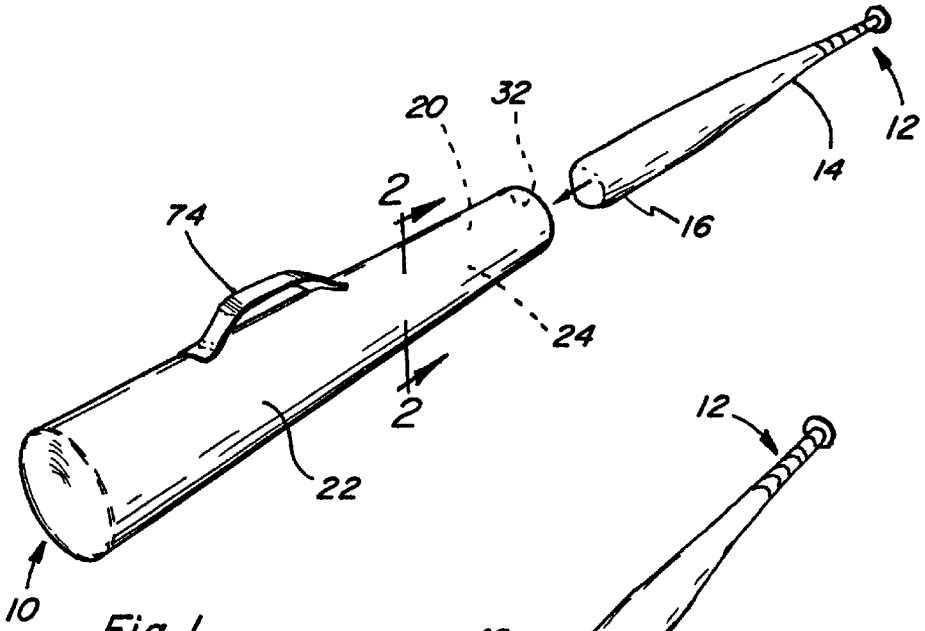
FIG. 1 is a perspective view of a warmer according to the present invention shown in an operative position for receiving a typical bat for baseball or softball in a cavity of the warmer.
Figure 2:
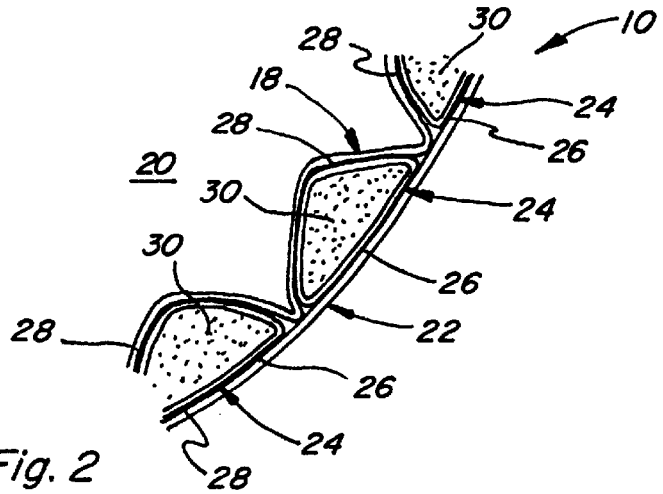
FIG. 2 is a fragmentary cross-sectional view of the warmer of FIG. 1 taken along line 2—2 thereof.

Referring now to the drawings, FIGS. 1 and 2 show a warmer 10 constructed and operable according to the teachings of the present invention for warming a typical prior art bat 12. Bat 12 is representative of a wide variety of bats of aluminum or other metallic materials used for striking softballs and baseballs. Bat 12 includes a narrow, elongate neck 14 tapering outwardly to a wider barrel 16.

Warmer 10 is a tapered tubular shaped member having an inner layer 18 of thermally conductive material such as an open mesh synthetic material knit, inner layer 18 defining a cavity 20 adapted for receiving and holding bat 12, including neck 14 and barrel 16 thereof. Warmer 10 includes an outer layer 22 of thermal insulating material such as a closed cell foamed synthetic material; a non-woven, fluffed, natural, semi-synthetic, or synthetic material such as a poly-fill material; a knitted material, or the like, which surrounds and encloses inner layer 18. An intermediate layer 24 including microwave heatable elements 26 is disposed between inner layer 18 and outer layer 20.

Each microwave heatable element 26 includes an outer liquid impermeable, microwave transmitting film 28 encasing a microwave activatable or heatable substance 30. Such substance can include a wide variety of well known materials which are heated by exposure to microwave radiation, including, but not limited to, the dry powder mixes disclosed in Salyer U.S. Pat. No. 5,211,949, issued May 18, 1993; the microwave-activated thermal storage material disclosed in Salee U.S. Pat. No. 5,424,519 issued Jun. 13, 1995; and the microwave-activated mixed-powder thermal storage material disclosed in Salee U.S. Pat. No. 5,630,961 issued May 20, 1997, which disclosures are incorporated herein by reference. Microwave heatable elements 26 can also include widely commercially available microwave heatable gel packets sold by Corningware under the trade name Pop-ins, or those available from Thera-Med of Waco, Texas, as well as other commercially available microwave heatable products.

Warmer 10 additionally includes an open end 32 in communication with cavity 20, which open end 32 is adapted for the passage of bat 12 into cavity 20 in the orientation shown cavity 20 having a size and shape such that inner layer 18 of warmer 10 is located in substantially conforming intimate relation with bat 12.

Figure 3:
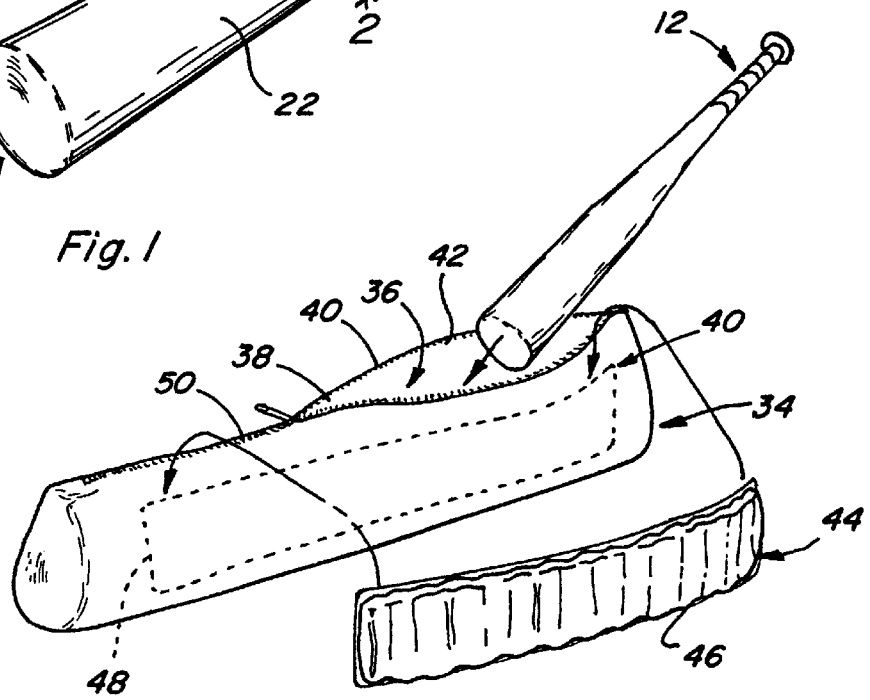
FIG. 3 is a perspective view of another embodiment of a warmer according to the present invention having removable microwave heatable elements, shown in association with a bat for baseball or softball.

FIG. 3 shows another warmer 34, like parts of warmer 34 and warmer 10 being identified by like numerals. Warmer 34 includes an inner layer 36 of a thermally conductive material such as an open mesh synthetic material knit which defines a cavity 38 adapted for receiving bat 12 with inner layer 36 in less conforming, but sufficiently close or intimate contact therewith to provide adequate heat transfer thereto. Warmer 34 includes an outer layer 40 of thermal insulating material such as closed cell foamed synthetic material; a non-woven, fluffed, natural, semi-synthetic, or synthetic material; a knitted material, or the like surrounding inner layer 36. An opening 42 extends the length of warmer 34 and communicates with cavity 38 to allow insertion of bat 12 into cavity 38. Warmer 34 further includes an intermediate layer 44 disposed between inner layer 36 and outer layer 40, intermediate layer 44 including two microwave heatable elements 46, one each of the elements 46 being located on opposite sides of cavity 38. Microwave heatable elements 46 can include any suitable microwave heatable substance such as the microwave heatable substances discussed above in reference to element 26 of warmer 10, here microwave heatable elements 46 each comprising a packet cooperatively receivable in a pocket 48 accessible through opening 42 of warmer 34. Warmer 34 additionally includes a zippered closure 50 operable for opening and closing opening 42 as desired.

Figure 4:
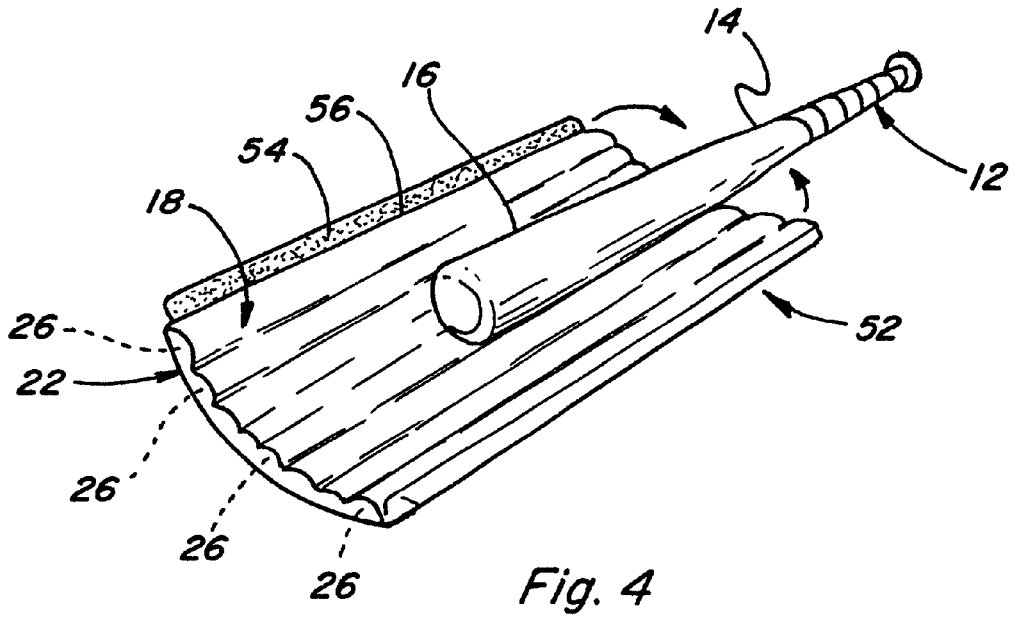
FIG. 4 is a perspective view of another embodiment of a warmer according to the present invention, the warmer being shown in association with a bat for baseball or softball in position for being wrapped therearound.

FIG. 4 shows another warmer 52 according to the present invention, like parts of warmer 52 and warmers 34 and 10 being identified by like numerals. Warmer 52 is of a layered construction substantially identical to that of warmer 10 including an inner layer 18, an outer layer 22, and an intermediate layer 24 including microwave heatable elements 26, constructed as herein described above. Warmer 52 differs from warmer 10 in that instead of permanently forming a cavity, such as the cavity 20 adapted for cooperatively receiving bat 12, warmer 52 is a generally flat member formable into a tube for receiving barrel 16 and a desired portion of neck 14 of the bat. Warmer 52 includes a strip 54 of one side of a hook and loop type fastener system, such as a Velcro brand hook and loop fastener system, along an edge 56, strip 54 being fastenable to the outer surface of outer layer 22 adjacent the opposite edge when warmer 52 is formed into a tube, to maintain that shape. In this way, warmer 52 can be formed into a tubular shape of different diameters adapted for use with different size bats, that portion of the warmer for receiving the neck of a bat being formable so as to have a tapered shape corresponding to that of the neck, and so as to be positionable in tighter conforming, intimate relation with bat 12 for improving heat transfer thereto.

Figure 5:
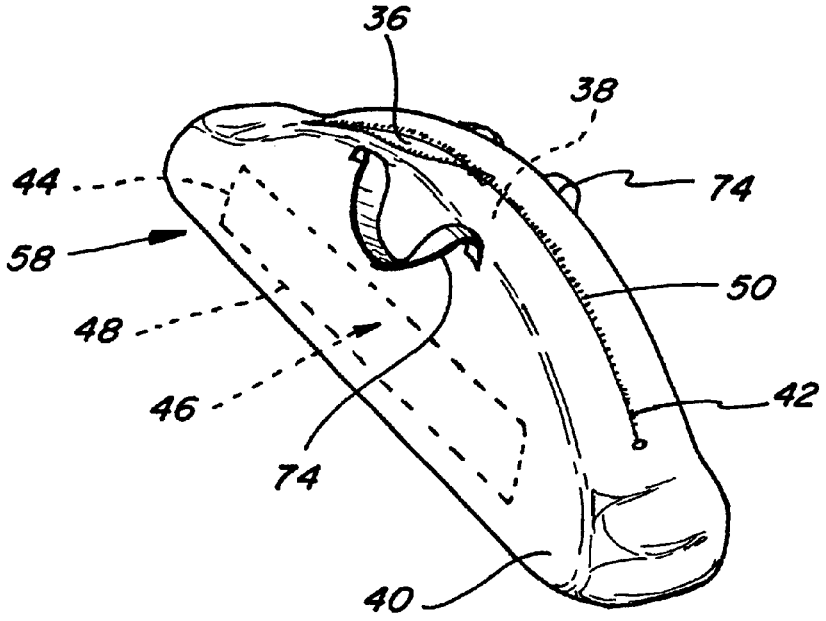
FIG. 5 is a perspective view of yet another embodiment of a warmer for a baseball or softball bat according to the present invention, the warmer including an internal cavity for receiving and holding a plurality of balls or other equipment.

Turning to FIG. 5, another warmer 58 according to the present invention is shown, warmer 58 being constructed essentially the same as warmer 34, including an inner layer 36 defining a cavity 38, an outer layer 40, an opening 42 communicating with cavity 38 closable using a zippered closure 50 and an intermediate layer 44 including microwave heatable elements 46 located in pockets 48 accessible through opening 42. Warmer 58 differs from warmer 34 in that cavity 38 is enlarged so as to be adapted for receiving and holding a plurality of baseballs or softballs, or other related sports equipment, in position to be warmed by intermediate layer 44.

Figure 6:
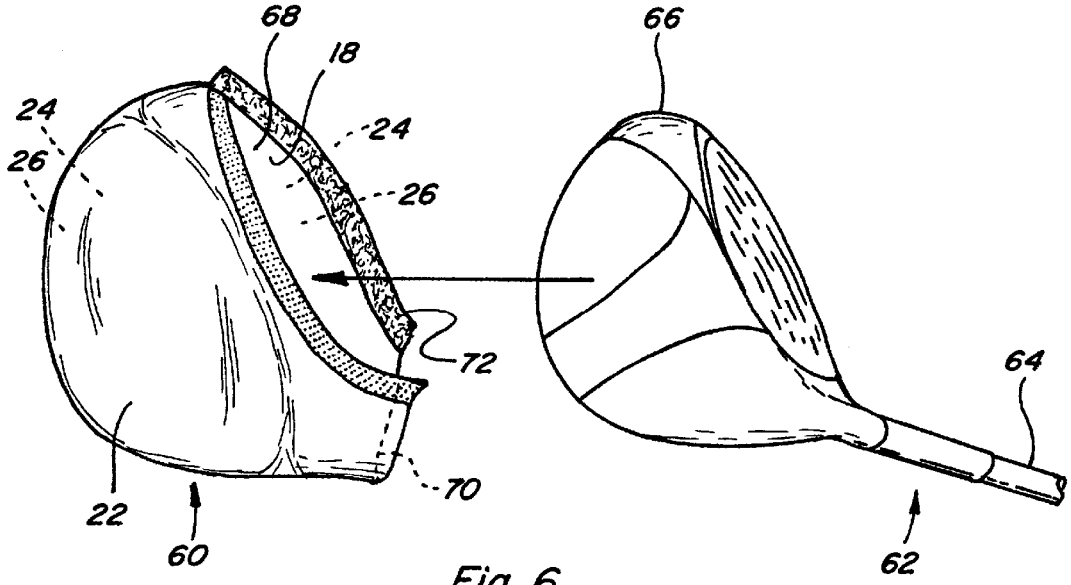
FIG. 6 is a perspective view of a warmer according to the present invention for use with a golf club, also shown.

FIG. 6 shows still another warmer 60 according to the present invention, warmer 60 being adapted for warming a golf club, such as golf club 62 shown. Golf club 62 is representative of a wide variety of commercially available golf clubs, particularly of the newer, metal wood variety having an elongate shaft 64 and a bulbous metal head 66 defining an enclosed cavity that can be empty, filled with the foamed material, or contain an air filled bladder (not shown). Warmer 60 includes an inner layer 18 of thermally conductive material, such as those discussed above, defining a cavity 68 adapted for receiving head 66 of golf club 62 with inner layer 18 preferably in substantially conforming intimate relation or contact therewith. Warmer 60 further includes an outer layer 22 of the above discussed thermal insulating material surrounding inner layer 18, and an intermediate layer 24 including a plurality of microwave heatable elements 26 disposed between inner layer 18 and outer layer 22, elements 26 including any of the microwave heatable substances 30 discussed hereinabove. Warmer 60 further includes an opening 70 communicating with cavity 68, and a hook and loop closure strip 72 extending around a portion of opening 70 for securing warmer 60 around head 66.

Figure 6A:
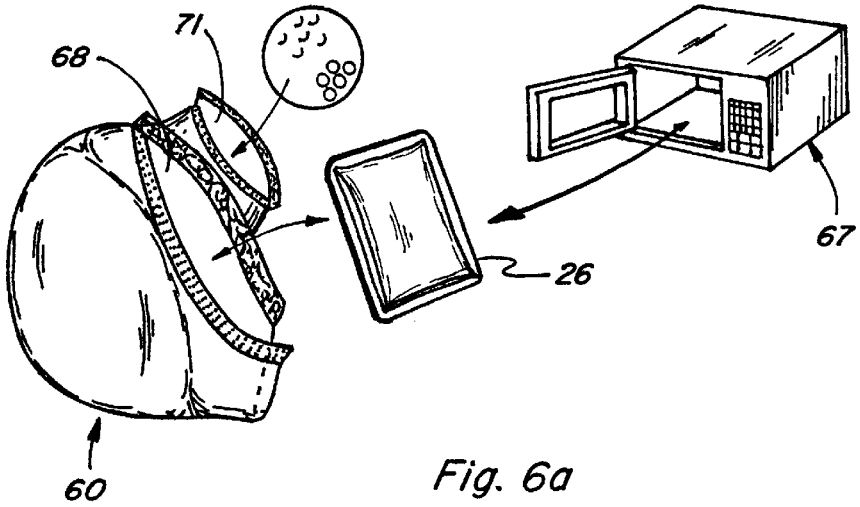
FIG. 6*a* is a perspective view of the warmer of FIG. 6 including an alternative removable microwave heatable element insertable into a microwave oven, also shown; and a cavity adapted for receiving a golf ball.

FIG. 6*a* shows warmer 60 constructed as explained above but with an alternative microwave heatable element 46 instead of elements 26, element 46 being removable therefrom and insertable into a microwave oven such as conventional household microwave oven 67 shown. Warmer 60 also includes an additional cavity 71 adapted for receiving a conventional golf ball as shown in position to be warmed by element 46. Alternatively, cavity 71 could be a part of or connected to cavity 68, as desired.

To use any of warmers 10, 34, 52, 58 and 60, first the respective microwave heatable elements 26 or 46 thereof are heated in a microwave oven such as microwave oven 67 (FIG. 6*a*) as required to provide the desired warming effect. This can be done by either inserting the entire warmer in a microwave oven, or, in the instance of microwave heatable elements 46, heating only the elements 46 then placing the elements in the warmer. The sporting element, a ball bat such as the bat 12 in the instance of warmers 10, 34, 52 and 58, and a golf club, such as golf club 62 in the instance of warmer 60, is then placed in the warmer and the warmer secured therearound. With the warmer secured around the sporting implement, heat from the microwave heatable elements 26 or 46 is then transferred to the sporting element over time, thereby warming it. Then, to use the sporting implement, it is simply removed from the warmer. After use, the sporting implement can be replaced in the warmer, as desired. Similarly, balls and other sporting items stored in the warmer with the supporting element are warmed, and can be removed and used as desired.

It has been found that the warmers according to the present invention are operable to warm a bat, golf club, or other sporting element sufficiently such that it reaches and is maintained at a temperature of at least 65° F. for a length of time adequate for most applications wherein the sporting implement is to be transported from a user's home or workplace to an athletic field, golf course, or the like. The close or intimate conformance of the warmer to the sporting element greatly facilitates heat transfer from the microwave heatable element or elements to the sporting implement such that even, thorough warming thereof is achieved, including heatable elements such as foamed material, enclosed air spaces and air filled bladders and the like that may be contained within a hollow portion or cavity of the sporting element.

As noted above, many makers of aluminum softball and baseball bats do not recommend use of the bats at an ambient temperature of less than 65° F. When the warmers of the present invention are used, it has been found that a bat can be maintained at a temperature of at least 65° F., even when ambient air temperatures are as low as 45° F. or lower, if the bat is first warmed in the warmer, then stored in the warmer when not in use during a game.

As further noted above, the warmers of the present invention can be utilized for enhancing the performance of a sporting element such as a bat or a golf club. In this regard, it has been observed that many commercially available microwave heatable elements currently sold to consumers, for example, the gel packs available from Corningware under the trade name Pop-ins, can be heated in a conventional home microwave oven such as oven 67 to a temperature of 110° F. or greater within a few minutes. To determine a representative degree of performance enhancement achievable when the present warmers are used, an aluminum ball bat was placed in a warmer similar to warmers 10 and 34 described hereinabove, including an outer layer of polyfill material and an inner layer of ⅛th inch foam having holes therethrough with an intermediate layer including two elements 46 which are Corningware Pop-ins each previously heated for about a minute and a half in a conventional home microwave oven having a power rating of 1000 watts. The bat, a new Louisville Slugger Air Attack 2 model aluminum bat representative of those commercially available at sporting goods stores and the like, was then attached to a mechanical bat swinging apparatus adapted for hitting balls off of a stationary tee on a swing plane oriented at about a 45° angle to horizontal. When initially removed from the warmer, the temperature of the aluminum hitting surface of the bat was measured using a digital thermometer and found to be about 110° F. Ambient temperature was about 70–72° F. Five new softballs were then each struck ten times with the test bat using the bat swinging apparatus, and the distance of travel of the struck balls was measured. To maintain the bat at approximately the initial 110° F. temperature, the bat was placed back in the warmer for 2½ to 3 minutes after every fourth ball struck. The balls struck by the bat heated to about 110° F. traveled an average distance of 95.75 feet. Then, the striking surface of the bat was cooled to about 45° F., and five new softballs of the same type were each struck by the bat using the swinging apparatus set up the same way under the same testing conditions, and the distance of travel of the balls measured. For the bat cooled to about 45° F., the average travel distance was 92.98 feet, or consistently more than three feet less than the distance of travel of the balls struck by the warmed bat. Thus, it is apparent that performance is enhanced by the present warmer.

This difference in the distance of travel of the struck ball is significant as it is believed that a ball struck with a bat warmed as described hereinabove will consistently travel correspondingly farther than a ball struck with a cool bat under the same swing conditions.

In the context of a practical application, many soft ball parks are constructed with outfield fences located about 300 feet from the batting area. A ball batted with a bat warmed to 110° F. or so will be expected to clear the outfield fence more easily than a ball batted with a bat at a lower temperature, particularly one at a temperature of 45° F. or so. Thus, it is expected that the performance enhancement achieved by warming a bat using the present warmer can mean the difference between a struck ball being a hit, or caught for an out. The impact on performance enhancement is expected to be more apparent when the sporting event, such as a baseball or softball game is played in the early spring or late fall, or at night, wherein ambient temperatures below 65° F. are to be encountered.

Figure 7:
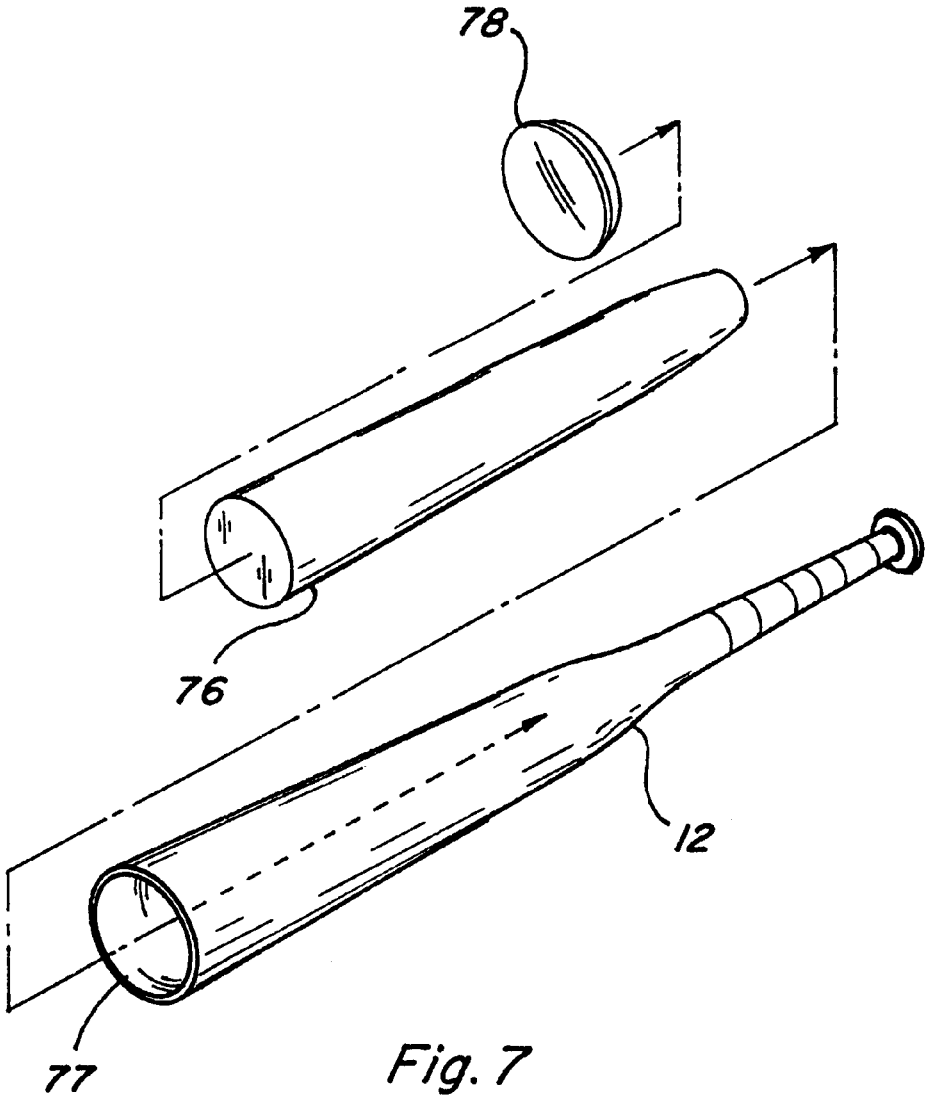
FIG. 7 is a perspective view of a bat including a heatable element receivable within a hollow barrel of the bat.

In the above regard, referring to FIG. 7, a sporting element such as a bat 12 can be provided with a permanent or removable heatable element 76 of a foamed material or the like capable of receiving and retaining heat located in a hollow barrel 77 thereof. Heatable element 76 can be removed from bat 12, and placed in a warmer containing heated elements 26 or 46, such as any of warmers 10, 34, 52 or 58 so as to be warmed thereby, then removed from the warmer and replaced in bat 12. Bat 12 can include any suitable means for retaining element 76, including, but not limited to, a frictionally or mechanically attachable end cap 78. Alternatively, heatable element 76 can be heated in place in bat 12 using any of the warmers 10, 34, 52 or 58 by heat transfer through the tubular side wall of the bat, element 76 thereby serving to maintain or extend the heated condition of the bat. As still another alternative, heatable element 76 can include or contain a microwaveable substance such as, but not limited to, any of those described hereinabove, so as to be heatable in a microwave oven such as oven 67 (FIG. 6*a*) then placed in the bat or other sporting element.

It should furthermore be noted that the warmers according to the present invention can include a wide variety of additional optional convenience features, for instance, handles such as handles 74. shown on warmers 10 and 58. Additionally, the outer layers of the respective warmers can include an outermost layer of tough, nylon or other fabric, for wearability, moisture resistance, and the like.

Thus there has been shown and described several embodiments of a novel warmer for sporting elements which fulfills all of the objects and advantages sought therefor. It will be apparent to those skilled in the art, however, that many changes, modifications, variations and other uses and applications for the subject warmers are possible and all such changes, modifications, variations and other uses and applications which do not depart from the spirit and scope of the invention are deemed to be covered by the invention which is limited only by the claims which follow.

What is claimed is:

1. A warmer for a bat for baseball or softball, the bat having an elongate neck and an elongate barrel wider than the neck, the warmer comprising in combination:

an inner layer of thermally conductive material defining an elongate generally cylindrical cavity enclosed at one end and open at an opposite end adapted for receiving the barrel and a desired portion of the neck of the bat with the inner layer in intimate relation therewith;

an outer layer of thermal insulating material at least substantially surrounding the inner layer; and an intermediate layer comprising at least one microwave heatable or activatable element disposed between the inner layer and the outer layer so as to be located in at least generally conforming relation to the bat when in the cavity.

2. The warmer, as set forth in claim 1, wherein the microwave heatable element is contained in a removable packet.

3. The warmer, as set forth in claim 1, wherein the warmer has a sufficiently small size so as to be insertable into a microwave oven operable for heating the microwave heatable element.

4. The warmer, as set forth in claim 1, comprising an opening in communication with the cavity adapted for receiving the barrel and desired portion of the neck of the bat, the inner layer having a shape and size adapted for intimately conforming to the barrel and neck of the bat.

5. The warmer, as set forth in claim 3, wherein the warmer is foldable to facilitate insertion into the microwave oven.

6. The warmer, as set forth in claim 1, comprising an elongate side having an opening in communication with the cavity adapted for receiving the barrel and desired portion of the neck of the bat, and closure means for closing the opening.

7. The warmer, as set forth in claim 1, comprising a handle on an exterior surface thereof.

8. The warmer, as set forth in claim 1, further comprising a cavity for receiving and holding at least one baseball or softball in position to be warmed by the intermediate layer.

9. The warmer, as set forth in claim 1, wherein the microwave heatable or activatable element comprises a mixture of a liquid phase including a microwave active fluid and a solid phase comprising phase change particles suspended in the liquid phase.

10. The warmer, as set forth in claim 1, wherein the microwave heatable or activatable element comprises a mixture of a first powder comprising calcium silicate impregnated with a microwave sensitive material, and a second powder comprising calcium silicate impregnated with a phase-change material.

11. The warmer of claim 1 wherein the microwave heatable or activatable element comprises a substance heatable by exposure to microwave radiation encased in a microwave transmitting film.

12. The warmer of claim 1 wherein the microwave heatable element comprises a microwave heatable gel packet.

13. A warmer for a sporting element used for striking another element, the sporting element including a head portion having a bulbous shape, and an elongate portion substantially narrower than the head portion extending from the head portion, the warmer comprising in combination:

an inner layer of thermally conductive material including a first portion defining a cavity having a bulbous shape adapted for receiving at least a substantial portion of the head portion of the sporting element with the inner layer in intimate relation therewith, and a second portion defining an opening connecting to the cavity, the second portion being substantially narrower than the cavity for receiving at least a portion of the narrower elongate portion of the sporting element;

an outer layer of thermal insulating material at least substantially containing the inner layer; and an intermediate layer comprising a microwave heatable or activatable substance disposed between the inner layer and the outer layer so as to be located in at least generally conforming relation to the head portion of the sporting element when in the cavity.

14. The warmer, as set forth in claim 13, wherein the sporting element comprises a metal bat.

15. The warmer, as set forth in claim 13, wherein the microwave heatable or activatable substance comprises a mixture of a liquid phase including a microwave active fluid and a solid phase comprising phase change particles suspended in the liquid phase.

16. The warmer, as set forth in claim 13, wherein the microwave heatable or activatable substance comprises a mixture of a first powder comprising calcium silicate impregnated with a microwave sensitive material, and a second powder comprising calcium silicate impregnated with a phase-change material.

* * * * *